US006976577B2

(12) United States Patent
Devine

(10) Patent No.: US 6,976,577 B2
(45) Date of Patent: Dec. 20, 2005

(54) MINT PACKAGE

(75) Inventor: Daniel Devine, Rockton, IL (US)

(73) Assignee: Cadbury Adams USA, LLC, Rye Brook, NY (US)

( * ) Notice: Subject to any disclaimer, the term of this patent is extended or adjusted under 35 U.S.C. 154(b) by 0 days.

(21) Appl. No.: 10/637,907

(22) Filed: Aug. 8, 2003

(65) Prior Publication Data

US 2005/0029153 A1 Feb. 10, 2005

(51) Int. Cl.[7] ..... A45C 11/00
(52) U.S. Cl. ..... 206/37; 220/254.9; 220/348
(58) Field of Search ..... 206/37, 443, 525; 220/254.1, 254.7, 254.9, 345.1–345.4, 348, 220/349, 351; 221/303, 306, 307, 309

(56) References Cited

U.S. PATENT DOCUMENTS

| | | | | | |
|---|---|---|---|---|---|
| 1,090,264 | A | * | 3/1914 | Adams | 220/345.2 |
| 2,159,978 | A | * | 5/1939 | Parkin | 220/345.4 |
| 2,858,118 | A | * | 10/1958 | Perkins | 220/254.9 |
| 3,938,690 | A | * | 2/1976 | Butler | 220/254.9 |
| 4,057,167 | A | * | 11/1977 | Lee | 220/254.9 |
| 4,819,829 | A | * | 4/1989 | Rosten et al. | 220/345.3 |
| 4,880,712 | A | * | 11/1989 | Gordecki | 220/345.2 |
| 6,507,957 | B1 | * | 1/2003 | Ingram | 4/259 |

* cited by examiner

*Primary Examiner*—Luan K. Bui
(74) *Attorney, Agent, or Firm*—Robert G. Crouch; Marsh Fischmann & Breyfogle, LLP

(57) ABSTRACT

In accordance the present invention a package assembly 10 for the storage and distribution of a plurality of mints 14 is provided comprising a bottom container 12 for the storage of the plurality of mints 14, the bottom container 12 comprising a bottom container base 16 and a plurality of bottom container sidewalls 18. The package assembly 10 also includes an upper cover 24 including an upper cover top surface 36. The upper cover 24 is mountable to the bottom container 12. An arched longitudinal detent 38 is formed in the upper cover 24. The arched longitudinal detent 38 is comprised of a detent surface 40 having a detent width 42, a detent length 44 and a detent depth 46. A delivery orifice 54 is formed through a portion of the arched longitudinal detent 38 and has an orifice width 56 and an orifice length 58. The orifice width 56 and the orifice length 58 are sized to allow one of the plurality of mints 14 to pass through the delivery orifice 54. An engagement slot 60 is formed into the arched longitudinal detent 38, the engagement slot 60 having a slot width 63, a slot length 64, and a slot depth 66. The engagement slot 60 is preferably connected to said delivery orifice 54. A slidable arched tongue element 68 is movable between a tongue open position 72 and a tongue closed position 70. The tongue element 68 includes a tongue upper surface 74 and a tongue lower surface 76. The slidable arched tongue element 68 covers the delivery orifice 54 when in the tongue closed position 70 and the slidable arched tongue element 68 uncovers the delivery orifice 54 when in the tongue open position 72. A t-shaped tongue engagement element 92 is mounted to the tongue lower surface 76 and is comprised of a longitudinal vertical member 94 and a longitudinal horizontal member 96. The longitudinal vertical member 94 has a vertical member length 102, a vertical member width 98, and a vertical member depth 100. The longitudinal vertical member 94 is positioned within the engagement slot 60 such that the slidable arched tongue element 68 is slidably secured to the arched longitudinal detent 38.

24 Claims, 4 Drawing Sheets

MINT PACKAGE

TECHNICAL FIELD

The present invention relates generally to a package for the storage and distribution of mints and similar candy and more specifically a package for the storage and distribution of mints, or other confectionary product, with improved manufacturing and assembly characteristics.

BACKGROUND OF THE INVENTION

Packaging can no longer be treated as simply a utilitarian element utilized to bring a product to market. Appearance, ease of use, shape, configuration, and a variety of other packaging characteristics have been found to effect a customer's perception of the product contained within. Consumers may also attribute the perceived quality of the packaging with the product contained within. Additionally, the unique aspects of a packaging design and its unique functions can develop consumer identity that may further promote product sales.

As a result of such considerations, packaging design has taken on an increased significance to product manufacturers. Unique designs and dispensing features, in the case of mints or candy, can often result in complex packing designs. This may result in complex or time consuming manufacturing that may negatively impact the cost associated with a product's distribution. If these costs are passed on to the consumer, they may in turn negatively impact the perception of the product or its value. It is therefore of great import to develop packaging assemblies that may be produced with simple cost effective methods while continuing to provide novelty of function and unique perceptions to consumers.

It would therefore be highly desirable to have a new packaging assembly for the distribution of mints or other candies. It would further be highly desirable to have a packaging assembly with improved manufacturing and assembly characteristics.

SUMMARY OF THE INVENTION

In accordance the present invention a package assembly for the storage and distribution of a plurality of mints is provided comprising a bottom container for the storage of the plurality of mints, the bottom container comprising a bottom container base and a plurality of bottom container sidewalls. The package assembly also includes an upper cover including an upper cover top surface. The upper cover is mountable to said bottom container. An arched longitudinal detent is formed in the upper cover. The arched longitudinal detent is comprised of a detent surface having a detent width, a detent length and a detent depth. A delivery orifice is formed through a portion of the arched longitudinal detent and has an orifice width and an orifice length. The orifice width and the orifice length are sized to allow one of the plurality of mints to pass through the delivery orifice. An engagement slot is formed into the arched longitudinal detent, the engagement slot having a slot width, a slot length, and a slot depth. The engagement slot is preferably connected to said delivery orifice. A slidable arched tongue element is movable between a tongue open position and a tongue closed position. The tongue element includes a tongue upper surface and a tongue lower surface. The slidable arched tongue element covers the delivery orifice when in the tongue closed position and the slidable arched tongue element uncovers the delivery orifice when in the tongue open position. A t-shaped tongue engagement element is mounted to the tongue lower surface and is comprised of a longitudinal vertical member and a longitudinal horizontal member. The longitudinal vertical member has a vertical member length, a vertical member width, and a vertical member depth. The longitudinal vertical member is positioned within the engagement slot such that the slidable arched tongue element is slidably secured to the arched longitudinal detent.

Other objects and features of the present invention will become apparent when viewed in light of the detailed description and preferred embodiment when taken in conjunction with the attached drawings and claims.

DESCRIPTION OF PREFERRED EMBODIMENTS

Figure 1:
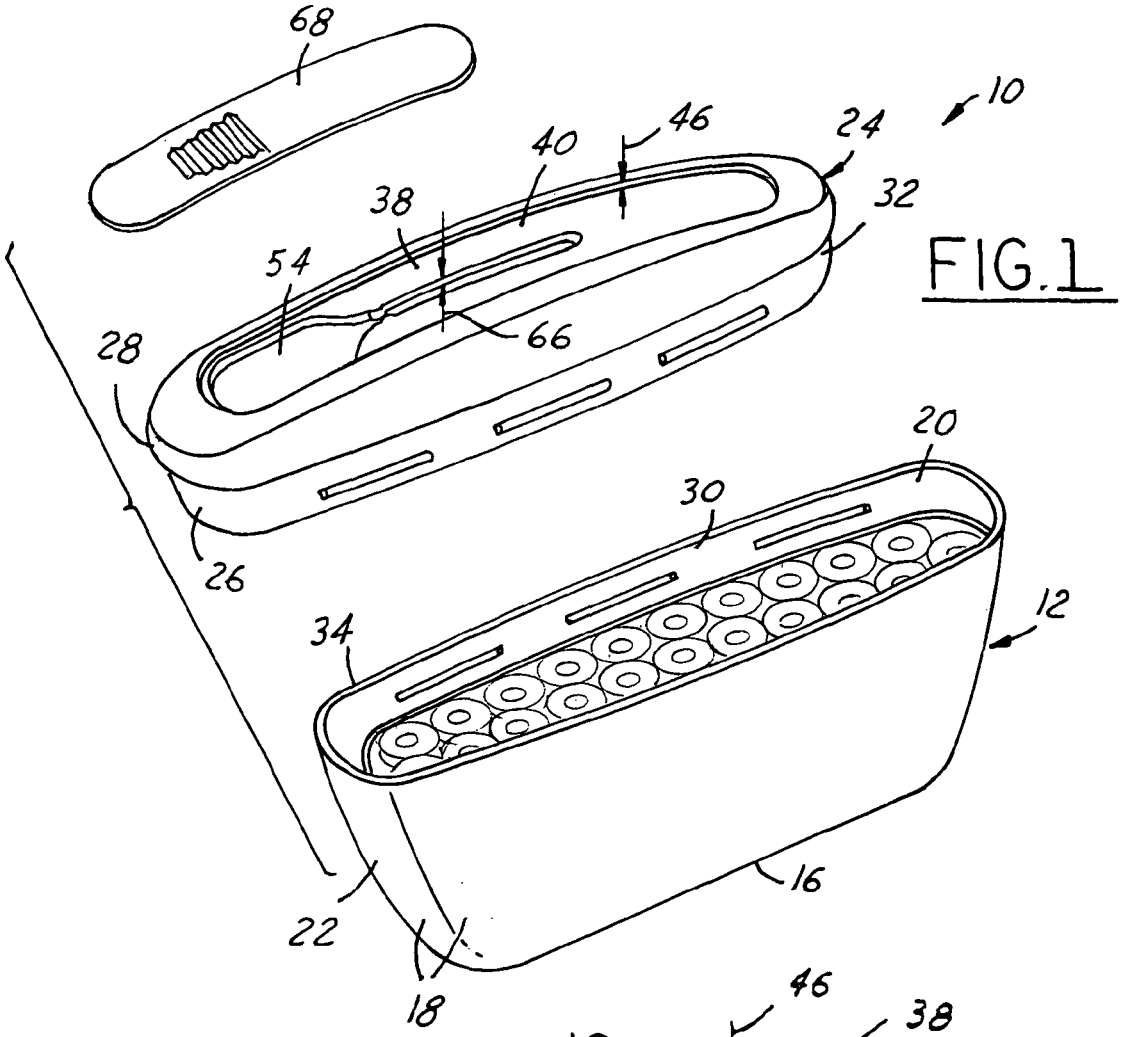
FIG. 1 is an exploded view of a package assembly in accordance with the present invention.

Referring now to FIG. 1, which is an illustration of a package assembly 10 for the storage and distribution of a plurality of mints in accordance with the present invention. The package assembly 10 is intended for the storage and distribution of mints or other similar candies. It is contemplated, however, that the present invention may be utilized for the storage and distribution of a variety of products. The package assembly 10 includes a bottom container 12 suitable for the storage of the plurality of mints (confectionary products) 14. The bottom container 12 is comprised of a bottom container base 16 and a plurality of bottom container sidewalls 18. The base 16 and sidewalls 18 are formed to generate a rectangular storage container with an open upper face 20. The sidewalls 18 and base 16 may be joined in a variety of fashions, however, one embodiment contemplates the use of rounded edges 22. Similarly, although the bottom container 12 may be manufactured in a variety of fashions, one embodiment contemplates injection molding the base 12.

The present invention further includes an upper cover 24, preferably injection molded, adapted to mate with the bottom container 12 to contain the plurality of mints 14. Although it is contemplated that this may be accomplished in a variety of fashions, one embodiment utilizes an indented perimeter 26 formed on the outer surface 28 of the upper cover 24. The indented perimeter 26 is designed to fit within the bottom sidewall inner perimeter 30 of the bottom container 12. A plurality of retention protrusions 32 are formed on the indented perimeter 26 and are designed to engage a matching plurality of retention grooves 34 formed in the bottom sidewall inner perimeter 30. This allows the upper cover 24 and the bottom container 12 to be coupled easily and is highly suitable for assembly automation procedures and machinery. In addition, after assembly the indented perimeter 26 allows the outer surface 28 of the upper cover 24 to remain flush with the sidewalls 18 of the bottom container 12. In this fashion, an appealing packaging assembly 10 is generated. By utilizing a separate upper cover 24, a single upper cover design 24 may be utilized on a wide variety of different sized bottom containers 12 and therefore manufacturing costs can be reduced.

Figure 4:
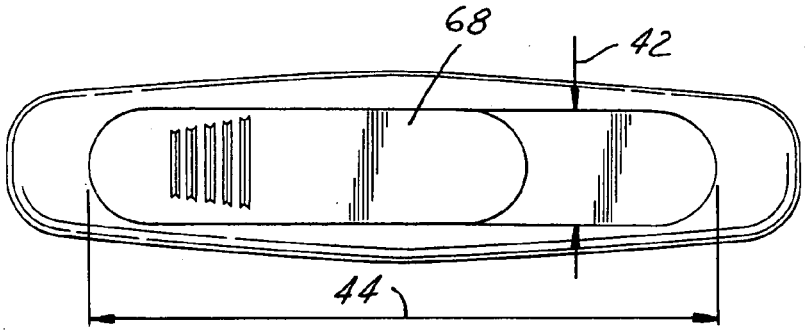
FIG. 4 is a detail of the illustration of the upper cover illustrated in FIG. 1.
Figure 5:
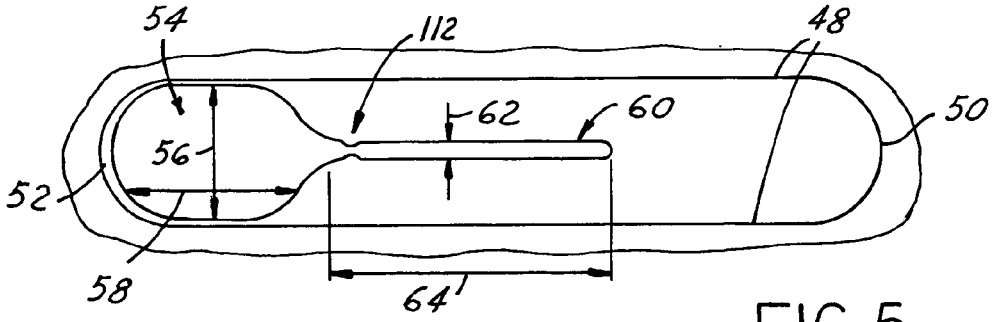
FIG. 5 is a detail illustration of a portion of the upper cover illustrated in FIG. 4, the detail highlighting the delivery orifice and engagement slot.

The upper cover 24 further includes an upper cover top surface 36. Although the upper cover top surface 36 may be formed in a variety of fashions, it is preferably arched. An arched longitudinal detent 38 is formed in the upper cover top surface 36 and is comprised of a detent surface 40 having a detent width 42, a detent length 44, and a detent depth 46 (see FIGS. 4 and 5). Although the arched longitudinal detent 38 may be formed in a variety of fashions, one embodiment contemplates the use of elongated detent sides 48 connecting a first rounded detent end 50 and a second rounded detent end 52. A delivery orifice 54 is formed through a portion of the arched longitudinal detent 38, preferably at one of the detent ends 50,52. The delivery orifice 54 has an orifice width 56 and an orifice length 58 that are sized to allow on of the plurality of mints 14 to pass through the delivery orifice 54. This provides a delivery mechanism through the upper cover 24 for dispensing the mints 14 stored within the base container 12. The upper cover 24 further includes an engagement slot 60 having a slot width 62, a slot length 64 (see FIG. 5) and a slot depth 66 (see FIG. 1). The engagement slot 60 runs longitudinal in direction and preferably is connected to the delivery orifice 54.

Figure 2:
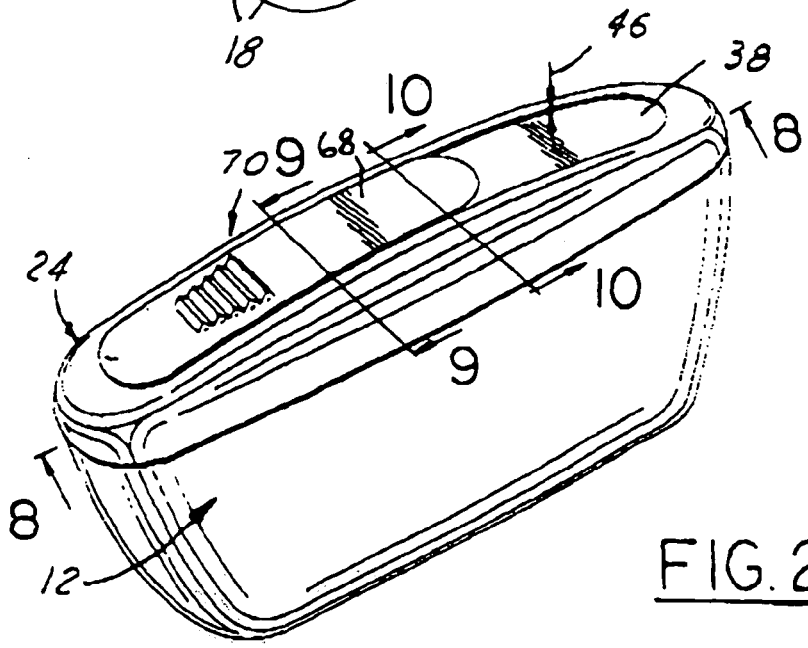
FIG. 2 is an assembled illustration of the package assembly illustrated in FIG. 1, the package assembly illustrated in the tongue closed position.
Figure 3:
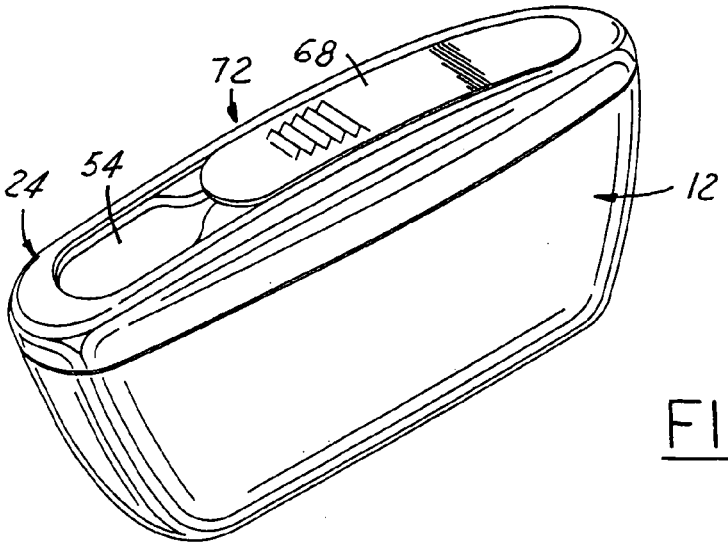
FIG. 3 is an assembled illustration of the package assembly illustrated in FIG. 1, the package assembly illustrated in the tongue open position.
Figure 6:
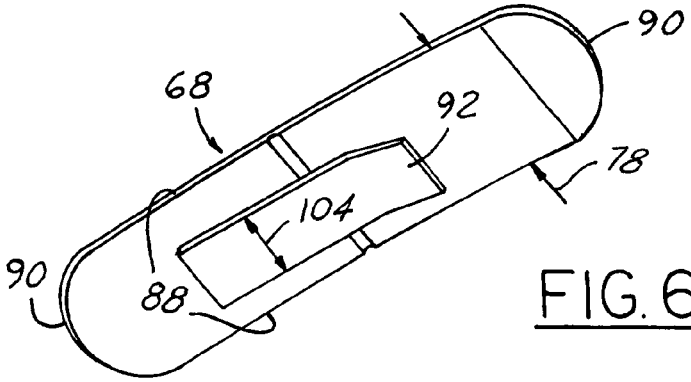
FIG. 6 is a bottom view of the tongue element illustrated in FIG. 4.
Figure 7:
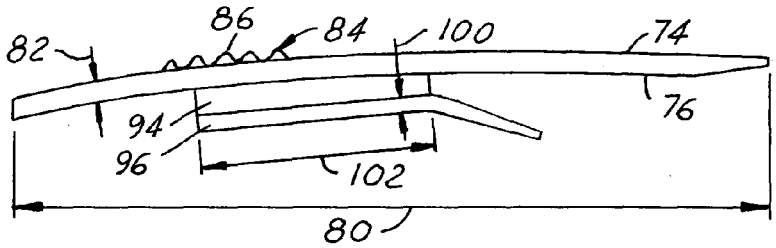
FIG. 7 is a side view illustration of the tongue element illustrated in FIG. 6.

The engagement slot 60 is utilized in combination with a slidable tongue element 68 in order to provide a convenient and simplistic method of closing off the delivery orifice 54. This allows the package assembly 10 to be relatively sealed such that the mints 14 are retained within the bottom container 12. The slidable tongue element 68 is preferably arched and movable between a tongue closed position 70 (see FIG. 2), wherein the delivery orifice 54 is covered, and a tongue open position 72 (see FIG. 3) wherein the deliver orifice 54 is uncovered. Although the slidable tongue element 68 may be formed in a variety of shapes and sizes, it is preferably arched as illustrated in FIGS. 6 and 7. The arch corresponds to the arch of the arched longitudinal detent 38 such that the slidable tongue element 68 can be moved smoothly over the detent surface 40. It is further contemplated that the slidable tongue element 68 is comprised of a tongue upper surface 74 and a tongue lower surface 76 defining a tongue width 78, a tongue length 80 and a tongue depth 82. The tongue width 78 is preferably approximately equal to the detent width 42 for both appearance and function. The tongue depth 82 is preferably equal to the detent depth 46 such that the tongue upper surface 74 remains flush with the upper cover top surface 36 (see FIGS. 8–10). A ribbed thumb pad 84, comprised of a plurality of rib elements 86 protruding above the upper cover top surface 36, facilitates movement of the slidable tongue element 68 by the consumer. Finally the slidable tongue element 68 is preferably formed with elongated straight tongue sides 88 and rounded tongue ends 90 to correspond roughly with the profile of the arched longitudinal detent 38.

Figure 8:
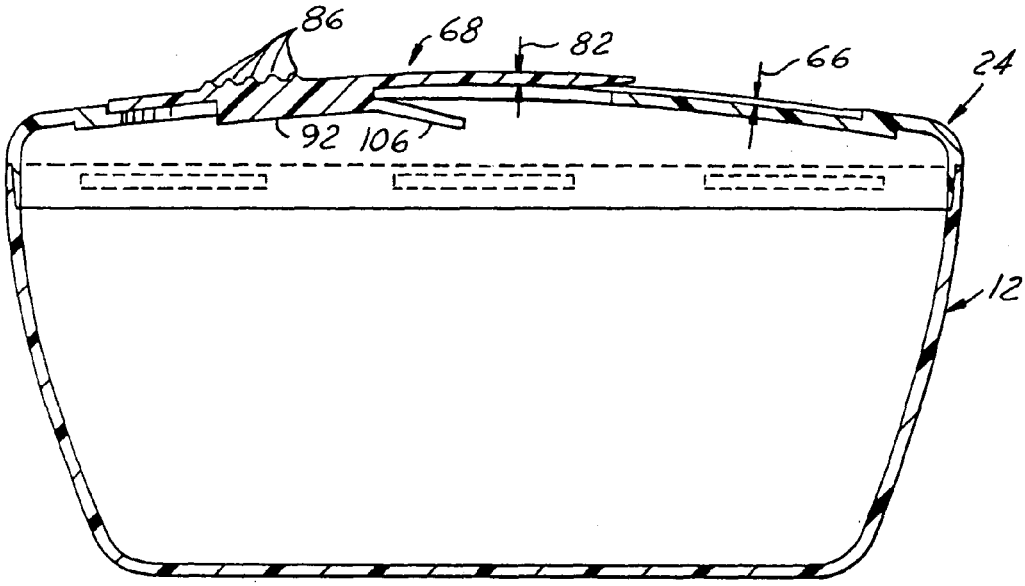
FIG. 8 is a cross-sectional view of the package assembly illustrated in FIG. 2, the cross-section taken along the lines 8—8 in the direction of the arrows.
Figure 9:
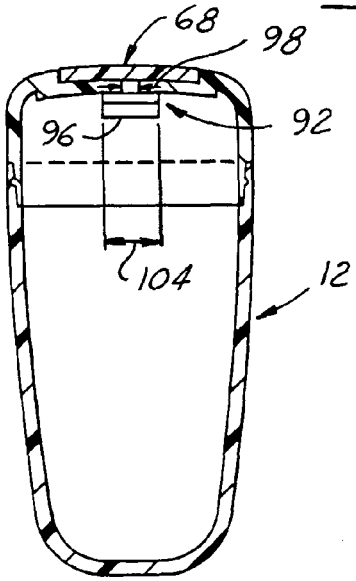
FIG. 9 is a cross-sectional view of the package assembly illustrated in FIG. 2, the cross-section taken along the lines 9—9 in the direction of the arrows.
Figure 10:
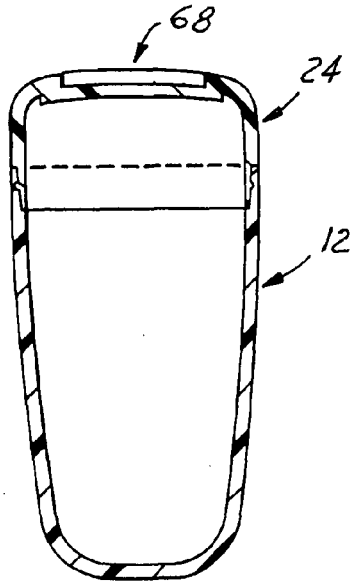
FIG. 10 is a cross-sectional view of the package assembly illustrated in FIG. 2, the cross-section taken along the lines 10—10 in the direction of the arrows.

The slidable tongue element 68 engages the upper cover 24 by way of a t-shaped engagement element 92 mounted to the tongue lower surface 76 (see also FIGS. 8 and 9). The t-shaped engagement element 92 is comprised of a longitudinal vertical member 94 and a longitudinal horizontal member 96 joined to form the t-shaped tongue engagement element 92. The longitudinal vertical member 94 is mounted to the tongue lower surface 76 and has a vertical member width 98 (see FIG. 9), a vertical member depth 100, and a vertical member length 102. The longitudinal vertical member 94 is positioned within the engagement slot 60 such that the slidable tongue element 68 is slidably secured to the arched longitudinal detent 38 (see FIGS. 8–10). The vertical member width 98 is preferably equal to slot width 62 and the vertical member depth is preferably equal to the slot depth 66 such that the slidable tongue element 68 is slidably secured within the longitudinal engagement slot 60. The horizontal member width 104 is preferably scaled such that the longitudinal horizontal member 96 engages the upper cover 24 and holds the slidable tongue element 68 against the detent surface 40 (see FIG. 9).

Figure 11:
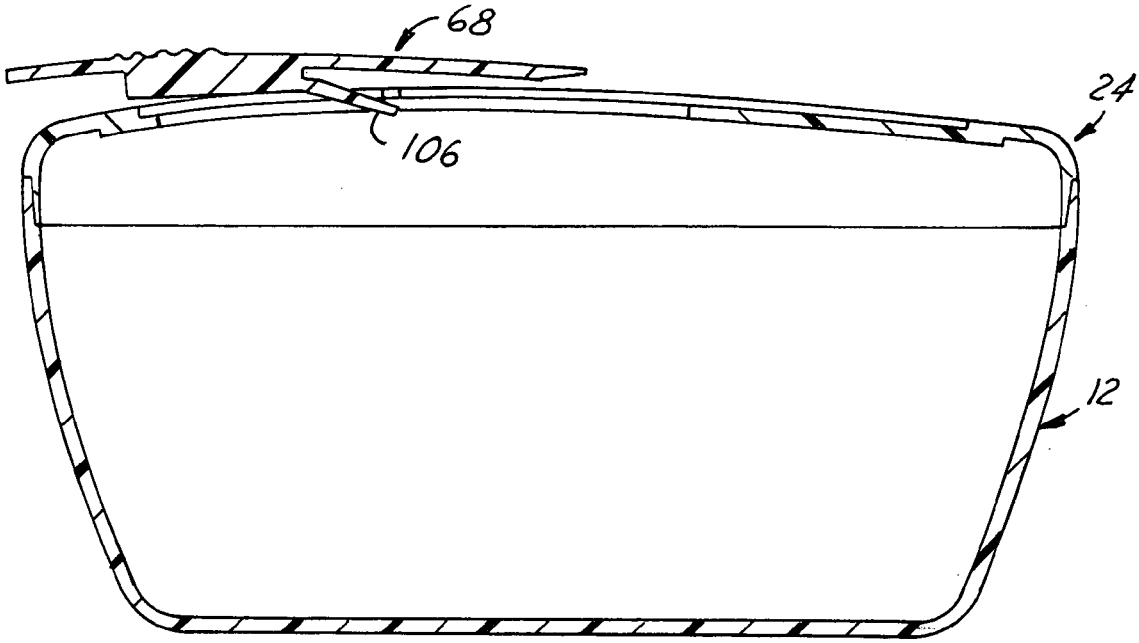
FIG. 11 is a detailed illustration of the package assembly illustrated in FIG. 8, the detail illustrating the slidable tongue element engaging the engagement slot.

The present invention can further include an assembly extension member 106 formed as an extension of the longitudinal horizontal member 96. The assembly extension member 106 includes a first extension member end 108 mounted to the longitudinal horizontal member 96 and a second extension member end 110 angled away from the tongue lower surface 76. This provides a convenient and simplistic assembly method for installing the slidable tongue element 68 into the engagement slot 60. As illustrated in FIG. 11, the slidable tongue element 68 can be directed towards the upper cover 24 in a horizontal direction and the assembly extension member 106, further assisted by an arched upper cover top surface 36 or detent surface 40, engages the deliver orifice 54 and guides the longitudinal vertical member 94 into the engagement slot 60. A slight flex of the slidable tongue element 68 then allows the arched tongue element 68 to be slid into position. This allows for automated assembly of the slidable tongue element 68 into the engagement slot 60 without complex operations.

The present invention may further included at least one restriction element 112 formed into the upper cover 24 and resisting the movement of the slidable tongue element 68 out of the tongue closed position 70. This is useful in keeping the assembly 10 closed such that mints 14 are not dispersed when the assembly 10 is thrown in a pocket, purse, or drawer. Although a wide variety of restriction elements 112 are contemplated, one embodiment contemplates the use of a restriction protrusion (preferably two) 114 formed into the engagement slot 60 (see FIG. 5). The restriction protrusion(s) 114 reduce the slot width 62 and therefore engage the longitudinal vertical member 94 and thereby resist movement of the tongue element 68. Although the restriction protrusions 114 may be placed in a variety of locations, one embodiment contemplates them to be placed on the engagement slot 60 where the engagement slot 60 connects to the delivery orifice 54.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A package assembly for the storage and distribution of a plurality of confectionary products comprising:

a bottom container for the storage of the plurality of confectionary products, said bottom container comprising a bottom container base and a plurality of bottom container sidewalls;

an upper cover including an upper cover top surface, said upper cover mountable to said bottom container;

an arched longitudinal detent formed in said upper cover, said arched longitudinal detent comprising a detent surface having a detent width, a detent length and a detent depth;

a delivery orifice formed through a portion of said arched longitudinal detent, said delivery orifice having an orifice width and an orifice length, said orifice width and said orifice length sized to allow one of the plurality of confectionary products to pass through the delivery orifice;

an engagement slot formed into said arched longitudinal detent, said engagement slot having a slot width, a slot length, and a slot depth, said engagement slot connected to said delivery orifice; and a slidable arched tongue element movable between a tongue open position and a tongue closed position, said tongue element including a tongue upper surface and a tongue lower surface, said slidable arched tongue clement covering said delivery orifice when in said tongue closed position, said slidable arched tongue element uncovering said delivery orifice when in said tongue open position; and a t-shaped tongue engagement element mounted to said tongue lower surface, said t-shaped tongue engagement element comprising a longitudinal vertical member and a longitudinal horizontal member joined to form said t-shaped tongue engagement element, said longitudinal vertical member having a vertical member length, a vertical member width, and a vertical member depth, said longitudinal vertical member positioned within said engagement slot such that said slidable arched tongue element is slidably secured to said arched longitudinal detent.

2. A package assembly as described in claim 1, further comprising:

at least one restriction element formed onto said upper cover, said at least one restriction element resisting movement of said slidable arched tongue element out of said tongue closed position.

3. A package assembly as described in claim 2, wherein said at least one restriction element comprises a restriction protrusion formed into said engagement slot, said restriction protrusion positioned to engage said longitudinal vertical member when said slidable arched tongue element is in said tongue closed position.

4. A package assembly as described in claim 1, further comprising:

an assembly extension member formed as an extension of said longitudinal horizontal member, said assembly extension member including a first extension member end mounted to said longitudinal horizontal member, and a second extension member end angled away from said tongue lower surface, said assembly extension member simplifying assembly of said slidable arched tongue element to said arched longitudinal detent.

5. A package assembly as described in claim 1, wherein said slidable arched tongue element includes a tongue element depth, said tongue element depth approximately equaling said detent depth such that said tongue upper surface is positioned generally flush with said upper cover top surface.

6. A package assembly as described in claim 1, further comprising:

a ribbed thumb pad molded into said slidable arched tongue element on said tongue upper surface, said ribbed thumb pad including a rib elements protruding above said upper cover top surface.

7. A package assembly as described in claim 1, wherein said slidable arched tongue element includes a tongue width and a tongue length, said tongue width substantially equaling said detent width.

8. A package assembly as described in claim 1, wherein said upper cover further comprises an indented perimeter having a plurality of retention protrusions, said plurality of retention protrusions engaging a plurality of retention grooves formed in a bottom sidewall inner perimeter of said bottom container sidewalls such that said upper cover is secured to said bottom container.

9. A package assembly for the storage and distribution of a plurality of candies comprising:

a bottom container for the storage of the plurality of candies, said bottom container comprising a bottom container base and a plurality of bottom container sidewalls;

an upper cover including an upper cover top surface, said upper cover mountable to said bottom container;

a delivery orifice formed through a portion of said upper cover, said delivery orifice having an orifice width and an orifice length, said orifice width and said orifice length sized to allow one of the plurality of candies to pass through the delivery orifice;

an engagement slot formed into said upper cover, said engagement slot having a slot width, a slot length, and a slot depth;

a slidable tongue element movable between a tongue open position and a tongue closed position, said tongue element including a tongue upper surface and a tongue lower surface, said slidable tongue clement coveting said delivery orifice when in said tongue closed position, said slidable tongue element uncovering said delivery orifice when in said tongue open position;

a t-shaped tongue engagement element mounted to said tongue lower surface, said t-shaped tongue engagement element comprising a longitudinal vertical member and a longitudinal horizontal member joined to form said t-shaped tongue engagement element, said longitudinal vertical member having a vertical member length, a vertical member width, and a vertical member depth, said longitudinal vertical member positioned within said engagement slot such that said slidable tongue element is slidably secured to said upper cover; and at least one restriction element formed onto said upper cover, said at least one restriction element resisting movement of said slidable tongue element out of said tongue closed position;

wherein said at least one restriction element comprises a restriction protrusion formed into said engagement slot, said restriction protrusion positioned to engage said longitudinal vertical member when said slidable tongue element is in said tongue closed position.

10. A package assembly as described in claim 9, further comprising:

a longitudinal detent firmed in said upper cover, said longitudinal detent comprising a detent surface having a detent width, a detent length and a detent depth, said delivery orifice, said engagement slot, end said slidable tongue positioned within said longitudinal detent.

11. A package assembly as described in claim 9, further comprising:

an assembly extension member funned as an extension of said longitudinal horizontal member, said assembly extension member including a first extension member end mounted to said longitudinal horizontal member, and a second extension member end angled away from said tongue lower surface, said assembly extension member simplicity assembly of said slidable tongue element to said upper cover by guiding said longitudinal horizontal member under said upper cover top surface.

12. A package assembly as described in claim 9, further comprising:

a ribbed thumb pad molded into said slidable tongue element on said tongue upper surface, said ribbed thumb pad including a rib elements protruding above said upper cover top surface.

13. A package assembly as described in claim 9, wherein:

said upper cover top surface comprises an arched upper cover top surface; and said slidable tongue element comprises an arched slidable tongue element.

14. A package assembly as described in claim 9, wherein said engagement slot is connected to said delivery orifice.

15. A package assembly as described in claim 14, wherein said at least one restriction protrusion is positioned where said engagement slot is connected to said delivery orifice such that said at least one restriction protrusion engages said longitudinal vertical member when said slidable tongue element is in said tongue closed position.

16. A package assembly for the storage and distribution of a plurality of candies comprising:

a bottom container for the storage of the plurality of candies, said bottom container comprising a bottom container base and a plurality of bottom container sidewalls;

an upper cover including an upper cover top surface, said upper cover mountable to said bottom container;

a delivery orifice formed through a portion of said upper cover, said delivery orifice having an orifice width and an orifice length, said orifice width and said orifice length sized to allow one of the plurality of candies to pass through the delivery orifice;

an engagement slot formed into said upper cover, said engagement slot having a slot width, a slot length, and a slot depth;

a slidable tongue clement movable between a tongue open position and a tongue closed position, said tongue element including a tongue upper surface and a tongue lower surface, said slidable tongue element covering said delivery orifice when in said tongue closed position, said slidable tongue element uncovering said delivery orifice when in said tongue open position;

a t-shaped tongue engagement element mounted to said tongue lower surface, said t-shaped tongue engagement element comprising a longitudinal vertical member and a longitudinal horizontal member joined to form said t-shaped tongue engagement element, said longitudinal vertical member having a vertical member length, a vertical member width, and a vertical member depth, said longitudinal vertical member positioned within said engagement slot such that said slidable tongue element is slidably secured to said upper cover; and an assembly extension member formed as an extension of said longitudinal horizontal member, said assembly extension member including a first extension member end mounted to said longitudinal horizontal number, and a second extension member end angled away from said tongue lower surface, said assembly extension member simplifying assembly of said slidable tongue element to said upper cover by guiding said longitudinal horizontal member under said upper cover top surface.

17. A package assembly as described in claim 16, further comprising:

a longitudinal detent formed in said upper cover, said longitudinal detent comprising a detent surface having a detent width, a detent length and a detent depth, said delivery orifice, said engagement slot, and said slidable tongue positioned within said longitudinal detent.

18. A package assembly as described in claim 16, further comprising:

at least one restriction element formed onto said upper cover, said at least one restriction element resisting movement of said slidable tongue element out of said tongue closed position.

19. A package assembly as described in claim 18, wherein said at least one restriction element comprises a restriction protrusion formed into said engagement slot, said restriction protrusion positioned to engage said longitudinal vertical member when said slidable tongue element is in said tongue dosed position.

20. A package assembly as described in claim 16, further comprising:

a ribbed thumb pad molded into said slidable tongue element on said tongue upper surface, said ribbed thumb pad including a rib elements protruding above said upper cover top surface.

21. A package assembly as described in claim 16, wherein:

said upper cover top surface comprises an arched upper cover top surface; and said slidable tongue element comprises a slidable tongue element.

22. A package assembly as described in claim 16, wherein said engagement slot is connected to said delivery orifice.

23. A package assembly as described in claim 22, further comprising:

at least one restriction protrusion formed into said engagement slot, said at least one restriction protrusion positioned where said engagement slot is connected to said delivery orifice such that said at least one restriction protrusion engages said longitudinal vertical member when said slidable tongue element is in said tongue closed position.

24. A package assembly for the storage and distribution of a plurality of candies comprising:

a bottom container for the storage of the plurality of candies, said bottom container comprising a bottom container base and a plurality of bottom container sidewalls;

an upper cover including an upper cover top surface, said upper cover mountable to said bottom container, wherein said upper cover top surface comprises an arched upper cover top surface;

a delivery orifice formed through a portion of said upper cover, said delivery orifice having an orifice width and an orifice length, said orifice width and said orifice length sized to allow one of the plurality of candies to pass through the delivery orifice;

an engagement slot formed into said upper cover, said engagement slot having a slot width, a slot length, and a slot depth;

an arched slidable tongue element movable between a tongue open position and a tongue closed position, said tongue element including a tongue upper surface and a tongue lower surface, said slidable tongue element covering said delivery orifice when in said tongue closed position, said slidable tongue element uncovering said delivery orifice when in said tongue open position;

a t-shaped tongue engagement element mounted to said tongue lower surface, said t-shaped tongue engagement element comprising a longitudinal vertical member and a longitudinal horizontal member joined to form said t-shaped tongue engagement element, said longitudinal vertical member having a vertical member length, a vertical member width, and a vertical member depth, said longitudinal vertical member positioned within said engagement slot such that said slidable tongue element is slidably secured to said upper cover.

* * * * *

UNITED STATES PATENT AND TRADEMARK OFFICE

CERTIFICATE OF CORRECTION

PATENT NO. : 6,976,577 B2
DATED : December 20, 2005
INVENTOR(S) : Devine

It is certified that error appears in the above-identified patent and that said Letters Patent is hereby corrected as shown below:

Column 5,
Lines 35 and 36, delete “clement” and insert -- element --.

Column 6,
Line 47, delete “clement” and insert -- element --;
Line 47, delete “coveting” and insert -- covering --.

Column 7,
Line 5, delete “firmed” and insert -- formed --;
Line 8, delete “end” and insert -- and --;
Line 12, delete “funned” and insert -- formed --;
Line 18, delete “simplicity” and insert -- simplifying --.

Column 8,
Line 11, delete “number” and insert -- member --;
Line 36, delete “dosed” and insert -- closed --.

Signed and Sealed this

Fourth Day of April, 2006

JON W. DUDAS
*Director of the United States Patent and Trademark Office*